US005958564A

United States Patent [19]

Iwamoto et al.

[11] Patent Number: 5,958,564

[45] **Date of Patent: *Sep. 28, 1999**

[54] INK JET RECORDING SHEET

[75] Inventors: Kiyoshi Iwamoto; Senichi Yoshizawa, both of Shizuoka, Japan

[73] Assignee: Tomoegawa Paper Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/773,320

[22] Filed: Dec. 24, 1996

[30] Foreign Application Priority Data

Dec. 27, 1995 [JP] Japan ..... 7-352683

[51] Int. Cl.[6] ..... B41M 5/00

[52] U.S. Cl. ..... 428/212; 428/195; 428/207; 428/331; 428/409; 428/500

[58] Field of Search ..... 428/195, 212, 428/331, 500, 207, 409

[56] References Cited

U.S. PATENT DOCUMENTS 4,780,356 10/1988 Otouma et al. ..... 428/212

FOREIGN PATENT DOCUMENTS 0 685 344 6/1995 European Pat. Off. .
61-92886 5/1986 Japan .
3-140284 6/1991 Japan .
8-258403 10/1996 Japan .

OTHER PUBLICATIONS

Patent Abstracts of Japan, vol. 12, No. 346, (M–742), Sep. 16, 1988, JP 63 104878, May 10, 1988.

Patent Abstracts of Japan, vol. 18, No. 526, (M–1683), Oct. 5, 1994, & JP 06 183134, Jul. 5, 1994.

Patent Abstracts of Japan, vol. 18, No. 453, (M–1662), Aug. 24, 1994, & JP 06 143800, May 24, 1994.

Patent Abstracts of Japan, vol. 12, No. 116, (M–684), Apr. 13, 1988, JP 62 244689, Oct. 26, 1987.

*Primary Examiner*—Pamela R. Schwartz
*Attorney, Agent, or Firm*—Oblon, Spivak, McClelland, Maier & Neustadt, P.C.

[57] ABSTRACT

An ink jet recording sheet comprising: a support member; a first ink receiving layer comprising at least silica which is on the support member, and a second ink receiving layer comprising at least silica in different conditions from the conditions in the first ink receiving layer, and which is on the first ink receiving layer.

15 Claims, 1 Drawing Sheet

INK JET RECORDING SHEET

BACKGROUND OF THE INVENTION

1. Field of the Invention

The present invention relates in general to recording media, and relates in particular to an ink jet recording sheet having a long shelf life and excellent ink absorption and fixation properties, to provide clear high quality image suitable for use in ink jet printers.

2. Description of the Related Art

Increasing popularity of ink jet printers in recent years owes its success to the high quality of recorded images providing clarity, tonality and excellent color reproduction. Ink jet printers use inks which do not dry quickly to avoid plugging of the jet nozzles by dried ink particles. Because such inks are generally made by dissolving or dispersing such materials as binders, dyes, solvents and special purpose additives in water, recording sheets for use with ink jet printers are required to have an ability to absorb water. Therefore, receding sheets in use are provided with a quality to absorb water sufficiently and yet avoid the creation of unclear images.

To improve the receiving quality of water based ink into the recording sheet, i.e. ink absorption capability, there have been proposals to provide for an ink receiving layer in the recording sheet. The ink receiving layer is generally made by coating a base paper with an aqueous coating composed primarily of polyvinyl alcohol and containing materials having wetting affinity for the inks used in ink jet printers, such as lithiumchloride glycol, gelatin, hydroxyl ethylcellulose or carboxyl methylcellulose.

However, such conventional types of recording sheets, in practice, not only did not exhibit sufficient ink absorbing quality but presented an additional problem of inadequate drying (fixation) property. On the other hand, if an attempt is made to improve ink absorbability to a level sufficiently high to satisfy the fixation property, a problem of ink bleeding is created thus lowering the image clarity and degrading other recording qualities in general. It also causes associated problem of shelf-life such as bunching caused by the absorption of humidity and the resulting sticking of papers due to the formation of gooey surface.

SUMMARY OF THE INVENTION

It is an object of the present invention to provide a recording sheet exhibiting a good ink absorption property as well as offering image clarity and efficient fixation properties which is suitable for use with ink jet printers.

The object has been achieved in a recording sheet comprising: a support member; a first ink receiving layer comprising at least silica which is on the support member, and a second ink receiving layer comprising at least silica in different conditions from the conditions in the first ink receiving layer, and which is on the first ink receiving layer.

DESCRIPTION OF THE PREFERRED EMBODIMENTS

The support member of the recording sheet for ink jet printers includes such opaque materials as papers, cloths, unwoven cloths and in addition includes such plastics materials as polyethylene telephthalate, diacetate cellulose, triacetate cellulose, acryl polymers, cellophane, celluloid, polyvinyl chloride, polycarbonate, polyimide in the form of film, plate or as a coating on glass plates. The choice of the material for the support member is governed by considerations related to the purpose for recording, the applications of the recordings as well as technical considerations such as compatibility with the ink receiving layers.

The first ink receiving layer should comprise at least silica particles having an average particle size in the range of 1.0~10.0 $\mu$m, preferably 1.0~6.0 and most preferably 3.0~6.0 $\mu$m.

Moreover, it is preferable for the first ink receiving layer to disperse the silica particles in a binder resin.

The ratio of silica particles to the total weight of the first ink receiving layer is preferably 50~90 weight percent (w/o) or more preferably 60~80 w/o. When the silica particles concentration is less than 50 w/o, the beneficial effects as defined by the present invention is minimal. When the concentration of silica particles is increased beyond 90 w/o, there is a danger that such problems as lowering in the mechanical strength of the ink receiving layer and poor image quality caused by decrease in surface smoothness of the receiving layer may occur.

The second ink receiving layer comprises at least silica particles in different conditions from the conditions in the first receiving layer. The "different conditions from the conditions in the first receiving layer" means that a shape, an average particle size, a surface treatment method, properties, an adding amount, and the like of the silica used in the first ink receiving layer differ from those of the silica used in the second ink receiving layer.

An average particle size silica used in the second ink receiving layer is in the range of 7.0~25.0 $\mu$m, and more preferably 12.0~20.0 $\mu$m, which are at the higher range of the first ink receiving layer. Such restrictions on the silica particle size in the second ink receiving layer are effective in preventing permeation of the dye stuff into the layer underneath, so that the dye is fixed within the second layer, thereby improving the color vividness and image clarity of the printed impressions.

The proportion of the silica particles to the total weight of the second ink receiving layer should be 50~80 w/o and more preferably 50~70 w/o. When the silica particles concentration is less than 50 w/o, there is insufficient benefit as defined by the present invention. When the concentration of silica particles is increased beyond 80 w/o, there is a danger that such problems as lowering in the mechanical strength of the ink receiving layer and poor image quality caused by ink bleeding and decrease in surface smoothness of the receiving layer may occur.

In order to obtain excellent ink absorption, no ink bleeding, good color vividness, and clarity of the printed impressions, it is preferable that the amount of silica in the first ink receiving layer is equal or larger than the amount of silica in the second ink receiving layer.

The silica particles for use in the first and second ink receiving layers may be selected from any silica which are produced by commonly known techniques so long as the requirements for the respective particle size are satisfied. There are no particular restrictions as to the chemical composition and crystal structures of silica.

The average particle size referred to in the present invention is measured by Coulter counter, and is measured by dispersing the particles in distilled water by ultrasonic agitating for thirty seconds, and is related to their volumetric average particle size.

Regarding the binder resin used together with the silica particles in the first and second ink receiving layers, conventional binders commonly used in ink receiving layer may be used. There is no particular restrictions regarding the resin properties.

Binder resins may include polyvinyl alcohol polyvinyl pyrrolidone, polyvinyl butyral polyvinyl acetate, water soluble polyvinyl acetal, polyamide resins, oxidized starch, casein, gelatin, polyethylene oxide, polyethylene oxyazoline, (meta)acryl resins, polyester resins, polyurethane resins, SBR and NBR, and the like. In particular, those water soluble polymers such as polyvinyl alcohol, polyvinyl pyrrolidone, water soluble polyvinyl acetal, casein, polyethylene oxide, and the like are favored for their high quality fixation and storage properties.

In the second ink receiving layer, it is preferred to mix 10~60 w/o polyvinyl pyrrolidone in the binder resin to obtain an effect of fixing the dye component material near the surface of the ink receiving layer to produce an excellent color vividness property.

In particular, by using 30~55 w/o polyvinyl pyrrolidone in the second ink receiving layer, ink jet recording sheet having not only excellent color generation but high recording productivity (quick drying property) and resistance to bunching can be produced.

It is preferable to configure the first and second ink receiving layers having the chemical compositions described above such that the second ink receiving layer is directly mounted on top of the first ink reserving layer.

When the average particle size of the silica particles in the first ink receiving layer is smaller than that in the second ink receiving layer, when the printing process is carried out on the second ink receiving layer, it results in leaving the dye components in the second ink receiving layer while quickly absorbing other constituting components such as solvents and the like into the first ink receiving layer underneath, thereby avoiding bleeding in the second ink receiving layer and imparting high quality fixation and image clarity properties to the recording paper.

The first and second ink receiving layers of the present invention contains at least the binder resin and silica particles, but other additives such as pigments, polymers and special agents may be added thereto, as needed.

Such pigments may include such fillers as clay, mica, talc, kaolin, diatomaceous earth, calcium carbonate, barium sulfate, aluminum slicate, synthetic zealot, alumina, zinc oxide, lithopone, satin white, aluminum hydroxide, microparticles of acryl resins, microparticles of acryl-styrene resins, microparticles of silicone resins and microparticles of phenol resins.

Special purpose additives may include water-resistant materials to improve resistance to water absorption and ink bleeding such as melamine formaldehyde resins, urea formaldehyde resins, glyoxal, and zirconium-ammonium carbonate.

Other special purpose additives to improve productivity, recording or storage properties may include dispersive agents, fluoresce dyes, pH adjusting agents, defloculating agents, lubricating agents and preservative agents.

When the support member for the recording sheet is transparent, such special agents are added to the extent that would not degrade the light transmission properties of the support member.

In the following, a method of making the first and second ink receiving layers will be explained. Manufacturing of the ink receiving layers is carried out by applying a coating, an aqueous mixture or a mixture in a suitable solvent made by dissolving or dispersing the constituents required for making the respective layers, on a support member by such coating means as roll coater, blade coater, air knife coater or rod coater. Other coaters such as hot melt coater and laminate coater may also be utilized.

The quantity of coating to be applied to make the first ink receiving layer is preferably 8~30 g/m$^2$, and more preferably 10~20 g/m$^2$. The quantity of coating to be applied to make the second ink receiving layer is preferably 5~15 g/m$^2$, and more preferably 7~10 g/m$^2$. When the quantity of coating material is less than the ranges specified, there is a danger that the ink absorbing properties and fixation properties may not be sufficient, and on the other hand, when the quantity of coating exceed the ranges specified, the sheet production productivity may be reduced and the production cost may consequently be increased. Especially, when the coating weight exceeds 15 g/cm$^2$ in the second ink receiving layer, it becomes difficult for the ink to penetrate through the second ink receiving layer, thus leading to ink bleeding in the second ink receiving layer. This results in undesirable poor image clarity and should be avoided.

The value added attraction of the present ink jet recording sheet may be further enhanced by providing a glossy layer thereon. To provide such a glossy layer, different approaches may be taken such as by selecting the method of making the second ink receiving layer (laminating or making a glossy layer as described below) or the surface treatment method for the receiving surface of the second ink receiving layer by calendering or laminating a glossy layer on top of the second ink receiving surface.

It is preferable that such a glossy layer has a specular glossiness value of over 10 when measured according to the testing method for specular glossiness value by 60 degree (JIS Z8741).

The testing method for specular glossiness value by 60 degree (JIS Z8741) will be briefly explained below.

Measurement Apparatus

The specular glossiness value is determined using an apparatus shown in FIG. 1, in which a light beam having a given angle of spread is directed to the mirror surface at a specified angle of incidence, and the reflected beam of light having a given angle of spread is received in a light receiving device.

The opening S1 of the light source is placed at the focal point of the lens L2, and the mirror is placed at the test piece T. The image of S1 is formed in the center of the opening S2 of the light receiving device. The angle of incidence θ is given by the angle between the line joining the center of the opening S1 and the center of the lens L2 (principal point of the lens) and the line normal to the test piece T. The angle of reception θ' is given by the angle between the line joining the center of the opening S2 and the center of the lens L3 (principal point of the lens) and the line normal to the test piece T. The spreading angles α 1, α 2 are determined as the angles at the openings S1, S2 of the lens L2, L3. The spreading angles α 1' is determined as the angle of the image S1' of the opening S1 formed at the lens L3. The light axes of the incidence side and the light receiver side intersect on the surface of the test piece. The opening S1 may be replaced with a light filament of the light source placed at this point.

Measurement Conditions

For measuring the specular glossiness value, a light source which produces no polarization should be used, and the light source and the light receiving device should, in principle, use a light source which is equivalent to a combination of standard light and spectral luminous efficiency.

The light source should illuminate a width dimension of at least about 10 mm or more in the direction perpendicular to the incidence surface of the illuminated area of the test piece.

The measurement conditions are as follows:

| | |
|---|---|
| Angle of incidence (θ) | 60 ± 0.2° |
| Angle of reception (θ') | θ ± 0.1° |
| Spreading angle at light source | |
| plane of incidence (α1) | 0.75 ± 0.25° |
| plane of normal beam (β2) | 2.5 ± 0.5° |
| Spreading angle at light receiving device | |
| plane of incidence (α1) | 4.40 ± 0.1° |
| plane of normal beam (β2) | 11.7 ± 0.2° |

Method of Calculation

For a given angle of incidence θ , the luminous flux of the mirror reflection beam from the from the test piece and the reflected beam from the standard surface are measured, and the specular glossiness value is calculated as follows:

Gs (θ) (%)=(mirror reflection beam from test piece/reflection beam from standard surface)×(specular glossiness value of the standard surface)

There is no particular restriction regarding the composition of the glossy layer, however, it is preferable that it should be made up of the silica and the binder resin used in making the second ink receiving layer.

A method of making the glossy layer is to employ a transfer material having a poor adhesion to the second ink receiving layer, such as polyolefin resin film, 4-fluoroethylene resin film, peelable silicone, fabricated resin film, and apply a glossy material on the transfer material. The transfer material is laid down so that the coating on the transfer material faces the second ink receiving layer, and after it is dried, the transfer material is peeled off. Other suitable method may be used so long as it introduces no structural damage to the surface of the second ink receiving.

The proportion of the binder resin and the silica particles in the glossy layer is preferably in a range of 5~50 w/o of binder resin, and more preferably 5~30 w/o of binder resin to the weight of silica particles. If a glossy layer of more than 10 specular glossiness value is required, colloidal silica may be used to produce a glossy layer having excellent brightness, in particular quick ink drying properties and definition of the printed impressions.

The thickness of the glossy layer is preferably 5~12 μm, more preferably 8~10 μm so as to produce excellent glossiness while not damaging the functions of the first and second ink receiving layers.

Experimental Examples

Figure 1:
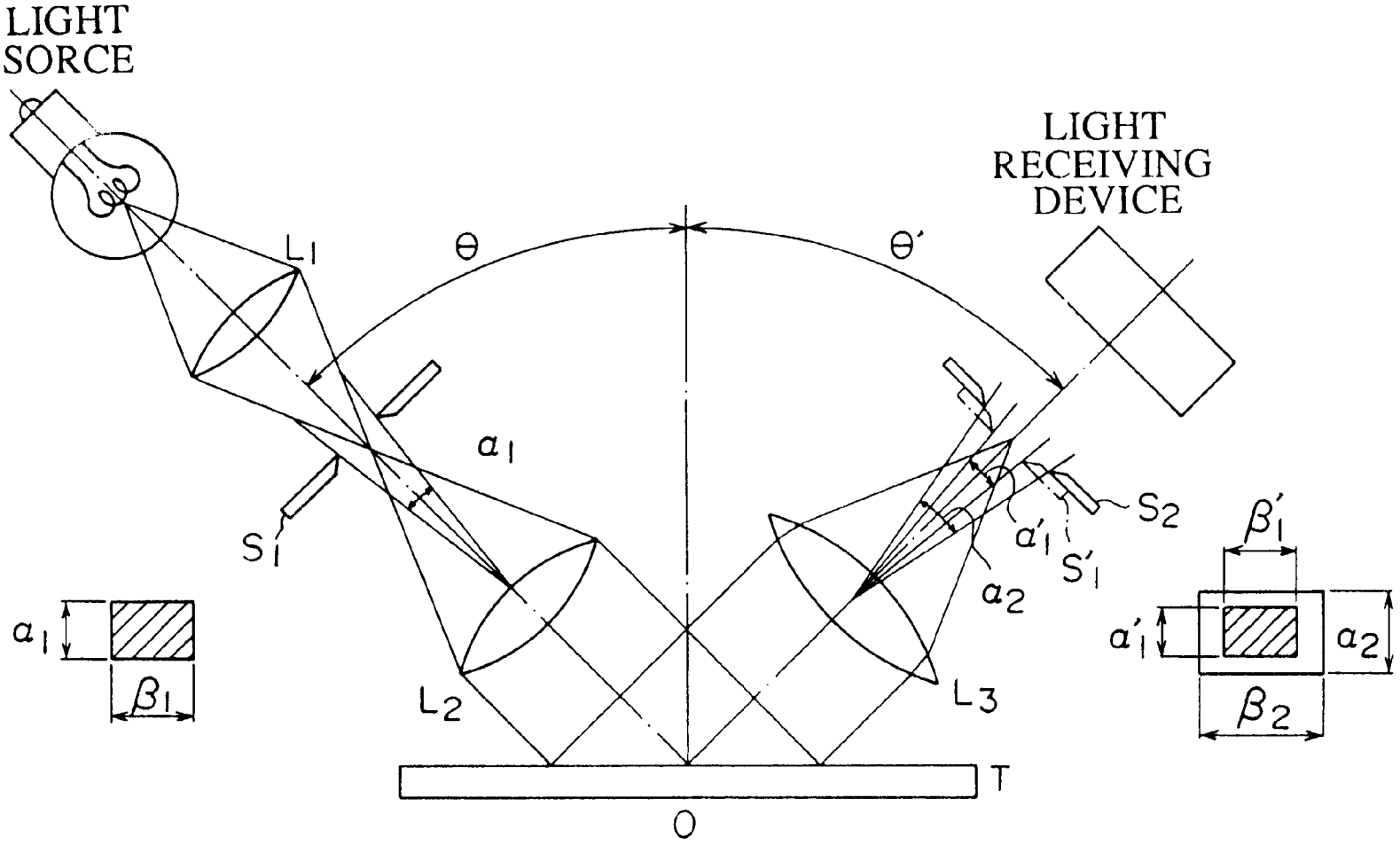
FIG. 1 is a schematic figure for explaining the testing method of specular glossiness value by 60 degree (JIS Z8741).

The present invention will be explained in detail hereinbelow with reference to examples. In the examples, and comparative examples, all "parts" and "%" mean "parts by weight" and "% by weight" respectively.

Example 1

Onto the wood free paper having a basic weight of 90 g/m$^2$, the coating solution having a following composition was coated. Then the first ink receiving layer was obtained by drying the coating solution. The solution was applied so that the amount of adhering solid was to 15 g/m$^2$ in dried state.

| (The composition of the coating solution for the first ink receiving layer) | |
|---|---|
| silica (trade name: CARPLEX BS-304 F, marketed by Shionogi & Co., Ltd., an average particle diameter: 5.3 μm) | 150 parts |
| polyvinyl alcohol (trade name: GOHSENOL T-330, marketed by The Nippon Synthetic Chemical Industry Co., Ltd., 10% solution) | 500 parts |
| melamine cross-linking agent (trade name: Sumirez Resin SR 613, marketed by Sumitomo Chemical Co., Ltd., solid component 80%) | 4 parts |

Onto the obtained first ink receiving layer, the coating solution having a following composition was coated. Then the second ink receiving layer was obtained by drying the coating solution. The solution was applied so that the amount of adhering solid was to 7 g/m$^2$ in dried state. The ink jet recording sheet of this Example was obtained in this manner.

| (The composition of the coating solution for the second ink receiving layer) | |
|---|---|
| silica (trade name: CARPLEX BS-304 F, marketed by Shionogi & Co., Ltd., an average particle diameter: 19.3 μm) | 100 parts |
| polyvinyl alcohol (trade name: GOHSENOL T-330, marketed by The Nippon Synthetic Chemical Industry Co., Ltd., 10% solution) | 400 parts |
| polyvinyl pyrrolidone (trade name: PVP K-90, marketed by GAF Co., Ltd., 10% solution) | 600 parts |

Example 2

The ink jet recording sheet of this Example was obtained in a manner identical to that of Example 1 of the present invention. However, the compositions of the first ink receiving layer and the second ink receiving layer were different from those of Example 1.

The compositions of the first ink receiving layer and the second ink receiving layer in this Example listed below.

| (The composition of the coating solution for the first ink receiving layer) | |
|---|---|
| silica (trade name: SILCRON G-100, marketed by SCM Chemicals, an average particle diameter: 4.5 μm) | 200 parts |
| polyvinyl alcohol (trade name: GOHSENOL T-330, marketed by The Nippon Synthetic Chemical Industry Co., Ltd., 10% solution) | 500 parts |

| (The composition of the coating solution for the second ink receiving layer) | |
|---|---|
| silica (trade name: Mizukasil P-78D, marketed by Mizusawa Industrial Chemicals, Ltd., an average particle diameter: 12.2 μm) | 150 parts |
| polyvinl alcohol (trade name: GOHSENOL T-330, marketed by The Nippon Synthetic Chemical Industry Co., Ltd., 10% solution) | 300 parts |
| polyvinyl pyrrolidone (trade name: PVP K-90, marketed by GAF Co., Ltd., 10% solution) | 800 parts |

Example 3

The ink jet recording sheet of this Example was obtained in a manner identical to that of Example 1 of the present invention. However, the compositions of the first ink receiving layer and the second ink receiving layer were different from those of Example 1.

The compositions of the first ink receiving layer and the second ink receiving layer in this Example are listed below.

| (The composition of the coating solution for the first ink receiving layer) | |
|---|---|
| silica (trade name: SILCRON G-100, marketed by SCM Chemicals, an average particle diameter: 4.5 μm) | 200 parts |
| polyvinyl alcohol (trade name: GOHSENOL T-330, marketed by The Nippon Synthetic Chemical Industry Co., Ltd., 10% solution) | 500 parts |

| (The composition of the coating solution for the second ink receiving layer) | |
|---|---|
| silica (trade name: CARPLEX BS-304 F, marketed by Shionogi & Co., Ltd., an average particle diameter: 19.3 μm) | 150 parts |
| polyvinyl alcohol (trade name: GOHSENOL T-330, marketed by The Nippon Synthetic Chemical Industry Co., Ltd., 10% solution) | 250 parts |
| polyvinyl pyrrolidone (trade name: PVP K-90, marketed by GAF Co., Ltd., 10% solution) | 450 parts |

Example 4

The ink jet recording sheet of this Example was obtained in a manner identical to that of Example 1 of the present invention. However, the composition of the second ink receiving layer was different from that of Example 1.

The composition of the second ink receiving layer in this Example is listed below.

| (The composition of the coating solution for the second ink receiving layer) | |
|---|---|
| silica (trade name: CARPLEX BS-304, marketed by Shionogi & Co., Ltd., an average particle diameter: 19.3 μm) | 150 parts |
| polyvinyl alcohol (trade name: GOHSENOL T-330, marketed by The Nippon Synthetic Chemical Industry Co., Ltd., 10% solution) | 500 parts |
| polyvinyl pyrrolidone (trade name: PVP K-90, marketed by GAF Co., Ltd., 10% solution) | 500 parts |

Example 5

The ink jet recording sheet of this Example was obtained in a manner identical to that of Example 1 of the present invention. However, the compositions of the second ink receiving layer were different from that of Example 1.

The composition of the second ink receiving layer in this Example is listed below.

| (The composition of the coating solution for the second ink receiving layer) | |
|---|---|
| silica (trade name: CARPLEX BS-304, marketed by Shionogi & Co., Ltd., an average particle diameter: 19.3 μm) | 150 parts |
| polyvinyl alcohol (trade name: GOHSENOL T-330, marketed by The Nippon Synthetic Chemical Industry Co., Ltd., 10% solution) | 700 parts |
| polyvinyl pyrrolidone (trade name: PVP K-90, marketed by GAF Co., Ltd., 10% solution) | 300 parts |

Examples 6~10

The coating solution for glossy layer having following composition was coated on the polyethylene films. The obtained polyethylene films in wet condition were applied on the surface of the second ink jet receiving layers of Examples 1 to 5. The ink jet recording sheets of these Examples were obtained by drying the glossy layers of Examples 6 to 10 on polyethylene films, detaching the polyethylene films, and drying again.

The solution for glossy layer was applied so that the amount of adhering solid was to 5 g/m$^2$ in dried state. The specular glossiness value by 60 degree of the obtained glossy layer was 30.

| (The composition of the coating solution for the glossy layer) | |
|---|---|
| colloidal silica (trade name: Snowtex ST-UP, marketed by Nissan Chemical Industries, Ltd., solid component 20%) | 250 parts |
| polyvinyl alcohol (trade name: GOHSENOL T-330, marketed by The Nippon Synthetic Chemical Industry Co., Ltd., 10% solution) | 50 parts |

Example 11

The ink jet recording sheet of this Example was obtained in a manner identical to that of Example 1 of the present invention. However, the second ink receiving layer was mounted on the wood free paper, and the first ink receiving layer was made on the second ink receiving layer in this Example.

Comparative Example 1

With the exception of omitting the first ink receiving layer, the ink jet recording sheet of this Comparative Example was obtained in the same manner as in Example 1.

Comparative Example 2

With the exception of omitting the second ink receiving layer, the ink jet recording sheet of this Comparative Example was obtained in the same manner as in Example 1.

Comparative Example 3

With the exception of omitting silica in the first ink receiving layer, the ink jet recording sheet of this Comparative Example was obtained in the same manner as in Example 1.

Comparative Example 4

With the exception of omitting silica in the second ink receiving layer, the ink jet recording sheet of this Comparative Example was obtained in the same manner as in Example 1.

The ink jet recording sheet obtained in Examples 1 to 11, and Comparative Examples 1 to 4 were cut to A4 size. The following printing tests were carried out with using the A4 size ink jet recording sheet, ink jet printer (trade name: MJ-5000C, marketed by Seiko Epson Co., Ltd.), and ink for ink jet printer (trade name: MJIC2C, marketed by Seiko Epson Co., Ltd.).

(1) Ink Absorption

After printing, the ink condition which was reminded in the printed face like beads was evaluated by eye. Evaluating standards were as follows:

A: condition of no remaining ink

B: condition of few remaining ink

C: condition that remaining ink can be confirmed

D: condition of remaining ink like beads (2) Color Vividness

The color vividness of the samples after printings were evaluated with eye. Evaluation standards were as follows:

A: very good

B: good

C: inferior

D: very inferior (3) Bleeding

Reappearance of printed dots was evaluated with a stereomicroscope (40 times). Evaluating standards were as follows:

A: shapes of dots being circluar or nearly circular

B: bleeding of dots can be rather confirmed, but the shape thereof is satisfactory C: bleeding of dots can be confirmed D: bleeding of dots is terrible, the shapes of dots is unsettle (4) Fixation Immediately after printing, a paper was lied on the printed ink jet recording sheet, and rubbed on the paper to the printed parts. Then, the transcribed condition of ink to paper was evaluated. Evaluating standards were as follows:

A: transcription of ink to paper can not be confirmed

B: transcription of ink to paper can not be almost confirmed

C: transcription of ink to paper can be confirmed, the fixation is inferior

D: a large quantity of ink is transcribed, the fixation is very inferior (5) Ink Drying Properties After printing, the duration (second) from the after-printing to a finger rubbed on the printed parts was not soiled was measured. Evaluating standards were as follows:

A: a finger is not soiled even if the printed parts rubbed with a finger immediately after printing (within 3 seconds)

B: a finger is soiled if the printed parts rubbed with a finger immediately after printing (within 3 seconds), but a finger is not soiled after 10 seconds after printing C: a finger is soiled after 10 seconds after printing, but after 20 second a finger is not soiled D: a finger is soiled after 20 seconds after printing (6) Image Density Imaged parts of printed samples were evaluated with print density measuring instrument (trade name: Macbeth Density Meter RD-914, marketed by Macbeth Co., Ltd.)

The results of the above-mentioned tests are shown in Table 1.

TABLE 1

| | Ink Absorption | Color Vividness | Bleeding | Fixation | Ink drying Properties | Image Density |
|---|---|---|---|---|---|---|
| Example 1 | A | B | A | A | A | 1.55 |
| Example 2 | A | B | A | A | A | 1.51 |
| Example 3 | A | B | A | A | A | 1.54 |
| Example 4 | A | B | A | A | A | 1.55 |
| Example 5 | A | B | A | A | A | 1.57 |
| Example 6 | A | A | A | A | A | 2.08 |
| Example 7 | A | A | A | A | A | 2.03 |
| Example 8 | A | A | A | A | A | 2.06 |
| Example 9 | A | A | A | A | A | 1.95 |
| Example 10 | A | A | A | A | A | 2.01 |
| Example 11 | B | B | B | B | A | 1.58 |
| Comparative Example 1 | C | D | D | C | B | 1.30 |
| Comparative Example 2 | C | C | D | C | B | 1.59 |
| Comparative Example 3 | C | C | C | C | C | 1.32 |
| Comparative Example 4 | D | C | D | D | D | 1.41 |

As is clear from Table 1, the ink jet recording sheets of the Examples have good ink absorption, vividness, bleeding, fixation properties. Moreover, in particular, the excellent ink absorption can be obtained by mounting the glossy layer. In contrast, the ink jet recording sheets of the Comparative Examples have inferior image properties.

What is claimed is:

1. An ink jet recoding sheet comprising:

a support member;

a first ink receiving layer on said support member comprising first silica particles; and a second ink receiving layer on said first ink receiving layer comprising second silica particles, wherein said first silica particles have a smaller average particle size than said second silica particles, and said second silica particles have an average particle size of at least 7.0 μm.

2. The ink jet recording sheet according to claim 1, wherein the first silica particles comprise 50 to 90% by weight of the first ink receiving layer, and the second silica particles comprise 50 to 80% by weight of the second ink receiving layer.

3. The ink jet recording sheet according to claim 2, wherein a glossy layer is mounted on the second ink receiving layer, said glossy layer having a specular glossiness value of greater than 10%, wherein said specular glossiness value is measured at a 60° angle of incidence.

4. The ink jet recording sheet according to claim 2, wherein the percent by weight of silica comprising the first ink receiving layer is equal to or more than the percent by weight of silica comprising the second ink receiving layer.

5. The ink jet recording sheet according to claim 4, wherein the average particle size of the first silica particles is 1.0 to 6.0 μm, and the average particle size of the second silica particles is 7.0 to 25.0 μm.

6. The ink jet recording sheet according to claim 5, wherein the second ink receiving layer comprises polyvinyl pyrrolidone as a binder resin, and wherein said polyvinyl pyrrolidone is 10 to 60% by weight of a total binder resin composition.

7. The ink jet recording sheet according to claim 6, wherein a glossy layer is mounted on the second ink receiving layer, said glossy layer having a specular glossiness value of greater than 10%, wherein said specular glossiness value is measured at a 60° angle of incidence.

8. The ink jet recording sheet according to claim 5, wherein a glossy layer is mounted on the second ink receiving layer, said glossy layer having a specular glossiness value of greater than 10%, wherein said specular glossiness value is measured at a 60° angle of incidence.

9. The ink jet recording sheet according to claim 4, wherein the second ink receiving layer comprises polyvinyl pyrrolidone as a binder resin, and wherein said polyvinyl pyrrolidone is 10 to 60% by weight of a total binder resin composition.

10. The ink jet recording sheet according to claim 9, wherein a glossy layer is mounted on the second ink receiving layer, said glossy layer having a specular glossiness value of greater than 10%, wherein said specular glossiness value is measured at a 60° angle of incidence.

11. The ink jet recording sheet according to claim 4, wherein a glossy layer is mounted on the second ink receiving layer, said glossy layer having a specular glossiness value of greater than 10%, wherein said specular glossiness value is measured at a 60° angle of incidence.

12. The ink jet recording sheet according to claim 2, wherein the second ink receiving layer comprises polyvinyl pyrrolidone as a binder resin, and wherein said polyvinyl pyrrolidone is 10 to 60% by weight of a total binder resin composition.

13. The ink jet recording sheet according to claim 12, wherein a glossy layer is mounted on the second ink receiving layer, said glossy layer having a specular glossiness value of greater than 10%, wherein said specular glossiness value is measured at a 60° angle of incidence.

14. The ink jet recording sheet according to claim 1, wherein a glossy layer is mounted on the second ink receiving layer, said glossy layer having a specular glossiness value of greater than 10%, wherein said specular glossiness value is measured at a 60° angle of incidence.

15. The ink jet recording sheet according to claim 14, wherein said glossy layer comprises colloidal silica particles.

* * * * *